United States Patent [19]

Blount

[11] Patent Number: 5,036,554

[45] Date of Patent: Aug. 6, 1991

[54] WATER SAVING TOILET CONSTRUCTION

[76] Inventor: Luther H. Blount, One Shipyard La., Warren, R.I. 02885

[21] Appl. No.: 600,253

[22] Filed: Oct. 22, 1990

Related U.S. Application Data

[63] Continuation of Ser. No. 356,360, May 24, 1989, abandoned.

[51] Int. Cl.[5] ..... E03D 1/00

[52] U.S. Cl. ..... 4/323; 4/321; 4/319; 4/435; 4/431

[58] Field of Search ..... 4/300, 321–323, 4/329–332, 663–665, 431–435, 319, 320; 241/46R 415/203, 204, 206

[56] References Cited

U.S. PATENT DOCUMENTS

| | | | |
|---|---|---|---|
| 1,790,470 | 1/1931 | Hansen | 415/206 |
| 2,198,605 | 4/1940 | Faber | 4/665 X |
| 2,431,161 | 11/1947 | Bjorklund | 241/46 R |
| 2,676,666 | 4/1954 | Howe | 4/319 X |
| 2,718,012 | 9/1955 | Howe | 4/319 |
| 3,067,433 | 12/1962 | Dietz et al. | 4/321 X |
| 3,155,046 | 11/1964 | Vaughan | 415/206 |
| 3,369,260 | 2/1968 | Sargent et al. | 4/435 |
| 3,396,410 | 8/1968 | Gray | 4/320 |
| 3,501,778 | 3/1970 | Minniear et al. | 4/321 X |
| 3,550,163 | 12/1970 | Jong | 4/323 X |
| 3,582,995 | 5/1971 | Enenstein | 4/321 X |
| 3,587,116 | 6/1971 | Quase | 4/300 |
| 3,601,820 | 8/1971 | Sargent et al. | 4/435 |
| 3,773,432 | 11/1973 | Chow et al. | 415/206 |
| 3,858,249 | 1/1975 | Howard | 4/323 X |
| 3,897,600 | 8/1975 | Barkholder | 4/319 |
| 4,114,203 | 9/1978 | Carolan | 4/323 X |
| 4,131,959 | 1/1979 | Albertassi et al. | 4/319 |
| 4,159,550 | 7/1979 | Tobin, Jr. | 4/319 |
| 4,286,342 | 9/1981 | Anthony | 4/321 |
| 4,310,934 | 1/1982 | Hennessy et al. | 4/321 |
| 4,311,281 | 1/1982 | Weis | 241/46 R |
| 4,333,185 | 6/1982 | Heinze et al. | 4/319 |
| 4,516,280 | 5/1985 | Tufts | 4/319 |
| 4,704,747 | 11/1987 | Brubakken et al. | 4/321 |
| 4,739,525 | 4/1988 | Degraw et al. | 4/319 |
| 4,819,279 | 4/1989 | Sigler et al. | 4/323 X |
| 4,842,479 | 6/1989 | Dorsch | 415/206 |

FOREIGN PATENT DOCUMENTS

| | | | |
|---|---|---|---|
| 2419911 | 10/1975 | Fed. Rep. of Germany | 4/320 |
| 447900 | 5/1936 | United Kingdom | 415/206 |
| 1243659 | 8/1971 | United Kingdom | 4/319 |
| 2185763 | 7/1987 | United Kingdom | 4/319 |

*Primary Examiner*—Henry J. Recla
*Assistant Examiner*—Casey Jacyna
*Attorney, Agent, or Firm*—Salter & Michaelson

[57] ABSTRACT

A water saving toilet construction includes a toilet unit which is adapted for flushing with less than approximately one gallon of water, a holding tank which is located beneath the toilet unit and a macerator discharge pump assembly which is operative for macerating waste effluent from the holding tank and discharging it into a sewer line. The holding tank has a volume of at least approximately two and one half gallons so that a sufficient volume of waste effluent can be discharged from the toilet at one time to minimize the potential for clogging the sewer line.

12 Claims, 2 Drawing Sheets

WATER SAVING TOILET CONSTRUCTION

This is a continuation of application Ser. No. 07/356,360 filed May 24, 1989 now abandoned.

BACKGROUND AND SUMMARY OF THE INVENTION

The instant invention relates to flush toilets and more particularly to a flush toilet which is adapted to operate with a minimal quantity of water.

In recent years water shortages have made it important to reduce water usage in many areas of the world. In this regard, it has been found that flush toilets often consume as much as 40% of the water supplied to domestic consumers and that as a result, the water used in flush toilets can represent a significant portion of the overall water usage in a particular geographical area. Consequently, a significant need has developed for an effective flush toilet which is capable of effectively operating with a minimal quantity of water.

While a variety of flush toilets have been heretofore available which have been adapted to operate with reduced amounts of water, it has generally been found that most of the heretofore available toilets of this type have been prone to causing blockages in sewer lines to which they are connected. In particular, it has been found that most of the heretofore available toilets which have been adapted to operate with reduced quantities of water (less than approximately two gallons) have been prone to causing blockages in sewer lines to which they are connected because they generally discharge waste materials into sewer lines at relatively low flow velocities which are insufficient to carry many solid waste materials into waste handling systems, such as septic tanks or municipal sewage facilities. It has been further found that this problem is compounded by the fact that most of the heretofore available flush toilets which have been adapted to operated with minimal quantities of water have discharged waste materials containing unmacerated solids which tend to cause blockages in residential sewer lines, particularly when they are discharged at relatively low flow velocities.

The instant invention provides a highly effective flush toilet construction which is adapted to overcome the sewer line blockage problems which have been experienced with the heretofore available flush toilets which have been adapted for reduced water usage. In particular, the toilet construction of the instant invention comprises a toilet unit including a bowl portion, an outlet portion defining an outlet passage which extends outwardly from the bowl portion, closure means for closing the outlet portion, and flushing means connectable to a supply of water for flushing the bowl portion and the outlet portion with a quantity of less than approximately one gallon of water. The toilet construction further comprises holding tank means having a waste inlet opening therein which opens into an interior holding chamber and discharge means which is connectable to a sewage pipe and actuatable for discharging waste from the interior holding chamber into the sewage pipe. The toilet unit is preferably received and supported on the holding tank means so that waste passing outwardly from the toilet unit passes downwardly through the outlet passage and into the interior holding chamber in the holding tank means. The holding tank means is constructed so that the interior holding tank chamber has a volume of at least approximately two one half gallons so that it can accommodate waste material from at least two flushes of the toilet unit before it is necessary to actuate the discharge means. Further, the holding tank means preferably has an interior bottom wall which is inclined downwardly and rearwardly at an angle of at least approximately 10° and defines the bottom of the interior chamber. The holding tank unit preferably has a volume of less than approximately six gallons to enable it to be effectively accommodated beneath the toilet unit with the toilet unit supported thereon and the closure means of the toilet unit preferably comprises mechanical closure means which is selectively operable in a closed position for mechanically obstructing the outlet portion of the toilet unit and an open position wherein waste material from the bowl portion can gravitate downwardly and outwardly into the holding tank means. The discharge means preferably comprises a centrifugal pump including a housing having an impeller cavity therein and an impeller which is rotatable about a substantially horizontal axis of rotation in the cavity. The pump housing has an inlet opening therein which is preferably positioned so that substantially the entire cross sectional area thereof is offset downwardly from the axis of rotation of the pump. Accordingly, the centrifugal pump is operative as a macerator pump which is capable of macerating waste material from the holding tank means before it is discharged into a sewer line. The centrifugal discharge pump is preferably further positioned so that the inlet opening thereof is partially above and partially below the upper surface of the adjacent portion of the downwardly inclined bottom wall in the holding tank means. The discharge means preferably still further comprises a discharge pipe which extends upwardly from the centrifugal macerator pump to at least approximately the elevation of the waste inlet in the holding tank means and then downwardly to a point below the elevation of the macerator pump. Even still further, the macerator pump is preferably positioned adjacent to the rear end of the holding tank means so that it defines the rearmost extremity of the toilet and the discharge pipe preferably extends upwardly from the macerator pump and then downwardly to a downwardly facing circular discharge outlet which is spaced forwardly from the rearmost extremity of the macerator pump by approximately 12 inches.

It has been found that the toilet construction of the instant invention can be effectively utilized in most domestic applications without causing chronic clogging problems in a residential sewer line connected thereto. In this regard, it has been found that because the toilet construction of the instant invention includes a holding tank means which is operative for holding waste material from several flushes, waste material can be discharged from the toilet at a sufficient velocity to advance it through a residential sewer line without clogging. Further, it has been found that because the discharge means preferably comprises a centrifugal pump having an inlet opening which is offset from the axis of rotation of the impeller thereof, the discharge means is operative for macerating waste material from the holding tank means before it is discharged into a sewer line so that the potential for clogging problems is even further reduced. In addition, it has been found that because the discharge pipe from the discharge pump extends upwardly to approximately the height of the inlet opening in the holding tank means and then downwardly to an elevation below the centrifugal pump, a portion of the material from the discharge pipe flows back into the centrifugal pump and the holding tank means when the centrifugal pump is deactuated to provide a liquid seal between the holding tank means and a sewer line connected to the discharge line. Further, it has been found that because the centrifugal pump preferably defines the rearmost extremity of the toilet and because the outlet from the discharge pipe is spaced forwardly from the rearmost extremity of the centrifugal pump by approximately 12 inches, the toilet construction of the instant invention can normally be installed in place of a conventional domestic toilet without piping modifications. Still further, it has been found that because the holding tank means has a volume of between approximately two and one half gallons and six gallons and because the toilet unit is supported on top of the holding tank means, the toilet construction of the instant invention normally occupies approximately the same area as a conventional flush toilet. Even still further, it has been found that because the toilet unit is preferably adapted to discharge material substantially directly downwardly into the holding tank means and because the toilet unit preferably comprises mechanical closure means, the toilet unit is operable with a minimal amount of flushing water and it has been found that because the bottom wall of the holding tank means is inclined downwardly and rearwardly, waste material from the toilet unit can effectively pass downwardly along the bottom wall of the holding tank means to the centrifugal pump where it is macerated before it is discharged into a sewer line.

Devices representing the closest prior art to the subject invention of which the applicant is aware are disclosed in the U.S. patents to DEMAREST, U.S. Pat. No. 274,182; HAGUE et al U.S. Pat. No. 1,957,831; DIRKS et al U.S. Pat. No. 3,576,038; ALBERTASSI et al U.S. Pat. No. 4,131,959; TOBIN, Jr. U.S. Pat. No. 4,159,550; HENNESSY et al U.S. Pat. No. 4,407,025; BARNUM et al U.S. Pat. No. 4,498,203; DAVID U.S. Pat. No. 4,543,674; and HEINZE et al U.S. Pat. No. 4,672,689. However, these references fail to suggest the concept of providing a toilet comprising a toilet unit which is supported on a holding tank and discharge means for discharging waste material from the holding tank into a sewer line wherein the toilet unit is operative with a minimal quantity of flushing water and wherein the holding tank is adapted to contain waste material from several flushes in order to increase the volume of the waste material which is discharged into the sewer line at one time. The above references also fail to suggest many of the other more specific features of the toilet construction of the instant invention and hence they are believed to be of only general interest with respect thereto.

Accordingly, it is a primary object of the instant invention to provide an effective water saving toilet construction.

Another object of the instant invention is to provide an effective toilet construction comprising a toilet unit which is operative with a minimal quantity of flushing water and supported on a holding tank which is located directly beneath the toilet unit.

An even further object of the instant invention is to provide a water saving toilet construction wherein waste material is macerated before it is discharged into a sewer line.

An even still further object of the instant invention is to provide a water saving toilet construction comprising a toilet unit and a holding tank which is adapted to be installed in place of a conventional domestic flush toilet.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
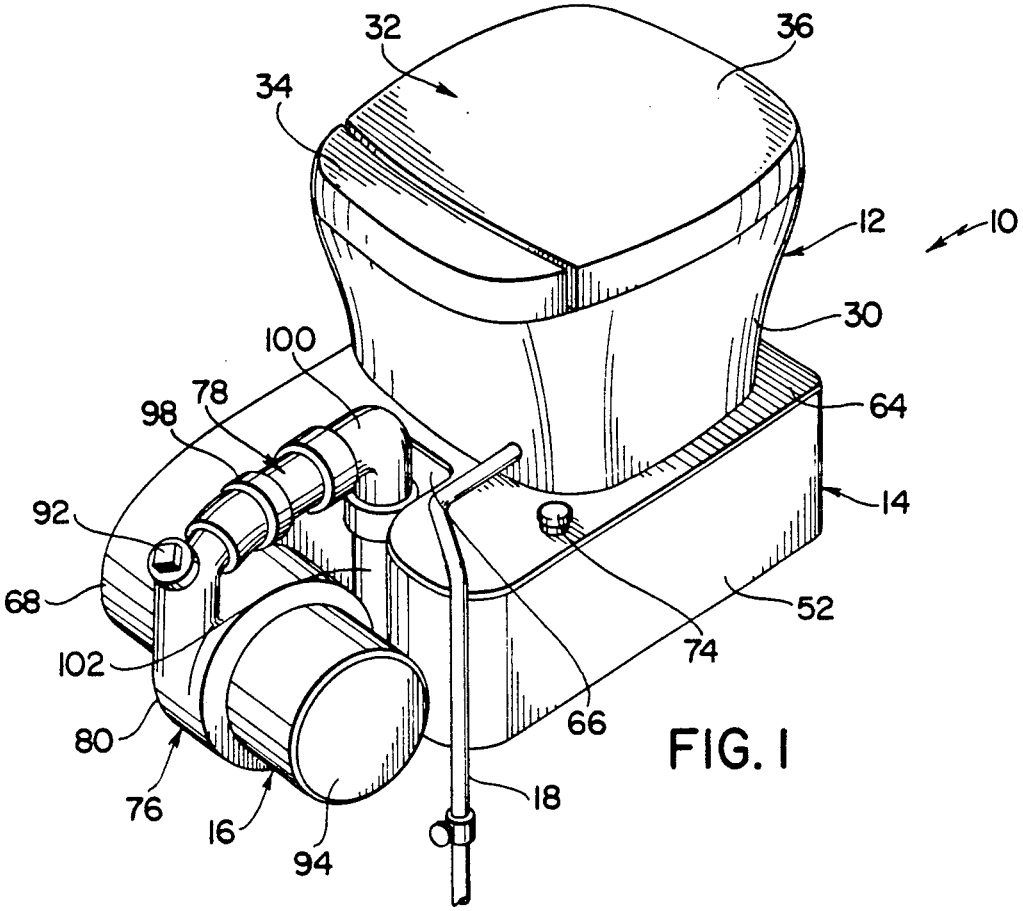
FIG. 1 is a perspective view of the toilet construction of the instant invention.

Referring now to the drawings, the toilet construction of the instant invention is illustrated and generally indicated at 10 in FIGS. 1 through 4. The toilet construction 10 comprises a toilet unit generally indicated at 12, a holding tank generally indicated at 14, and a discharge pump assembly generally indicated at 16 and it is adapted to be connected to a water supply line 18 and a sewer line 20. The toilet unit 12 is adapted to operate with a minimal quantity of flushing water from the supply line 18 and the holding tank 14 is adapted to store waste material from several flushes of the toilet unit 12. Accordingly, when the discharge pump assembly 16 is actuated to discharge waste material from the holding tank 14 into the sewer line 20, a sufficient quantity of waste material is discharged into the sewer line 20 so that the potential for causing clogging problems therein is minimized.

Figure 3:
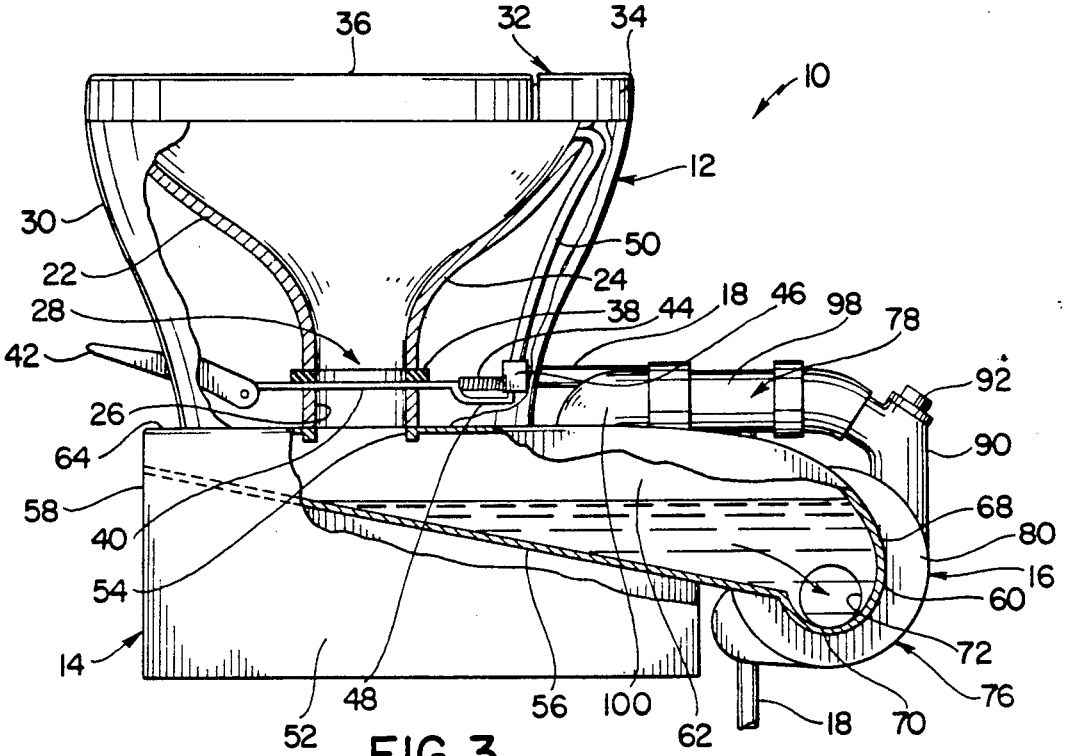
FIG. 3 is an opposite side elevational view thereof shown in partial section.

The toilet unit 12 preferably comprises a conventional toilet unit, such as a AQUAMATIC ® (Thetford Corporation TM) Galaxy Low recreational vehicle toilet unit manufactured by the Thetford Corporation of Dexter, Michigan. Toilet units of this general type are disclosed in the U.S. patents to Sargent et al U.S. Pat. Nos. 3,369,260 and 3,601,820, although it will be understood that a variety of other conventional toilet units which are adapted for reduced water usage can be effectively utilized in the toilet construction of the instant invention. As illustrated in FIG. 3, toilet unit 12 as herein embodied includes a bowl portion 22 which opens downwardly into an outlet portion 24. The outlet portion 24 defines a tubular outlet passage 26 which extends downwardly from the bowl portion 22 and a mechanical discharge valve assembly generally indicated at 28 is provided in the outlet passage 26. The bowl portion 22, the outlet portion 24 and the discharge valve assembly 28 are contained within a housing 30 and a seat assembly 32, including fixed and hingeable seat portions 34 and 36, respectively, is supported on the housing 30. The discharge valve assembly 28 includes a ring like seal 38 which is secured in the outlet portion 24, a gate member 40, a foot pedal 42 and a return spring 44. The gate member 40 is slidable on the under surface of the seal 38 between a closed position wherein it completely obstructs the outlet passage 26 and an open position wherein the passage 26 is substantially unobstructed. The foot pedal 42 is pivotally mounted in the housing 30 and it is connected to the gate member 40 for moving the gate member 40 from the closed position thereof to the open position thereof by depressing the foot pedal 42 downwardly. The return spring 38 is connected to the gate member 42 for returning the gate member 42 to the closed position thereof and the foot pedal 42 to a nondepressed position as soon as the foot pedal 42 is released. Also included in the toilet unit 12 is an inlet valve 46 which is connected to the water supply line 18. The inlet valve 46 is also connected to the gate member 40 through a linkage 48 and it is adapted so that as the gate member 40 is moved between the closed and open positions thereof the inlet valve 46 is also moved between closed and open positions, respectively. In this regard, it will be understood that while the inlet valve 46 is directly connected to the gate member 40 through the mechanical linkage 48 in the toilet unit 12 as herein embodied, other embodiments of the toilet unit which include various other types of connecting mechanisms, such as those which are adapted to provide delayed action in the opening and/or closing of the inlet valve 46 are contemplated. In any event, in the toilet unit 12 as herein embodied the valve 46 is connected to the bowl portion 22 through an inlet tube 50 which is operative for supplying water to the bowl portion 22 when the valve 46 is in an open position. Accordingly, the toilet unit 12 is operative for flushing waste material from the bowl portion 22 and/or the outlet portion 24 by depressing the foot pedal 42 to both open the gate member 40 and the inlet valve 46 so that waste material from the bowl portion 22 and the outlet portion 24 gravitates downwardly into the holding tank 14 while inlet water from the inlet line 18 flows into the bowl portion 22 through the water inlet tube 50.

Figure 4:
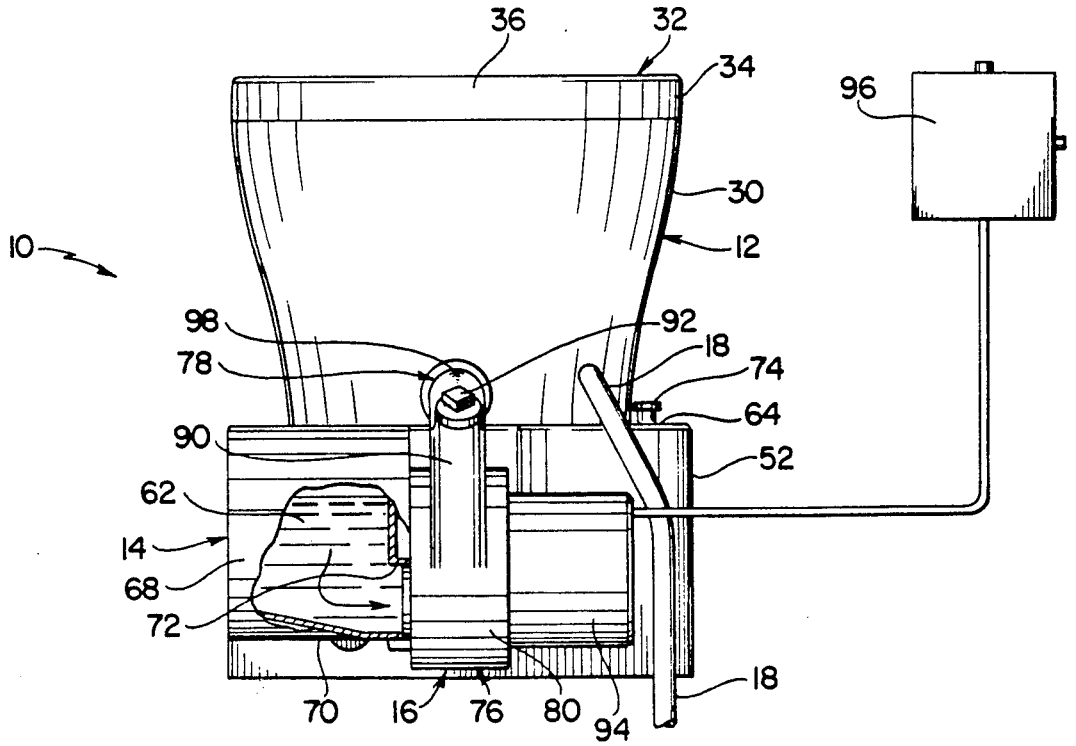
FIG. 4 is a rear elevational view thereof with an automatic remote control switch connected to the discharge pump.

The holding tank unit 14 is preferably molded from a suitable durable material, such a fiber glass, plastic or porcelain, in a generally rectangular configuration. The holding tank unit 14 is adapted for supporting the toilet unit 12 thereon and it includes a main outer housing 52 having an upwardly opening inlet opening 54 therein and an interior bottom wall 56. The housing 52 has front and rear ends 58 and 60, respectively, and the bottom wall 56 is inclined downwardly from the front end 58 toward the rear end 60 at an angle of at least approximately 10°. The bottom wall 56 preferably has a substantially smooth glossy upper surface thereon and it cooperates with the housing 52 to define an interior holding chamber 62 having a volume of between approximately two and one half gallons and six gallons. The housing 52 also includes a substantially horizontal upper wall 64 and the inlet opening 54 opens substantially directly downwardly through the upper wall 64 into the interior holding chamber 62 at a point which is forward of the mid point between the front and rear ends 58 and 60, respectively, of the housing 52. Still further, the inlet opening 54 is preferably located so that it is spaced upwardly from the bottom wall 56 by a distance of approximately 3 inches in order to prevent large objects from passing into the interior holding chamber 62 through the inlet opening 54. As illustrated in FIG. 1, a notched area 66 is formed in the rear portion of the housing 52 to accommodate a discharge pipe portion of the discharge pump assembly 16 as will hereinafter be more fully set forth. A rear outlet or discharge portion 68 extends rearwardly from the main portion of the housing 52 and as illustrated in FIG. 3, a slightly recessed rear discharge well 70 is formed in the lower rear portion of the discharge portion 68. The rear discharge well 70 is located adjacent the rear end 60 of the bottom wall 56 and as illustrated in FIG. 4, the bottom surface thereof is preferably inclined downward slightly toward the discharge pump assembly 16. An outlet opening 72 is formed in the rear discharge portion 68 so that it communicates with discharge well 70, the opening 72 being positioned partially above and partially below the elevation of the rear extremity of the bottom wall 56. Accordingly, material which enters the interior holding chamber 62 through the inlet opening 54 flows downwardly and rearwardly along the bottom wall 56 so that it passes into the discharge well 70 where it can be withdrawn through the outlet opening 72 with the discharge pump assembly 16. Also included in the holding tank assembly 14 is a vacuum breaker assembly 74 of conventional construction which is adapted for relieving vacuum from the interior holding chamber 62 as waste effluent is withdrawn therefrom with the discharge pump assembly 16.

Figure 2:
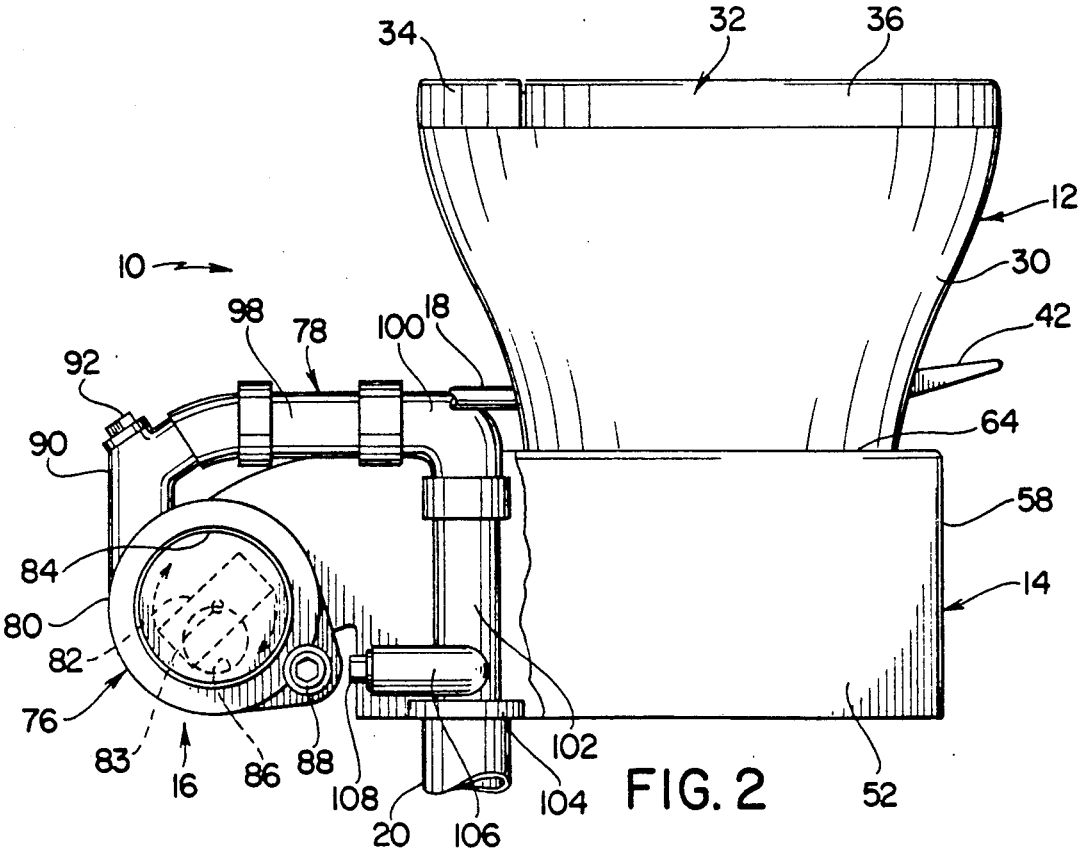
FIG. 2 is a side elevational view thereof.

The discharge pump assembly 16 comprises a centrifugal pump assembly generally indicated at 76 and a discharge or exhaust pipe assembly generally indicated at 78. The centrifugal pump assembly 76 includes a pump housing 80 which is preferably cast from a suitable material such as bronze or plastic, and an impeller 82 which is made of a suitable corrosion resistant material such as stainless steel and rotatable about an axis of rotation 83 in a cavity 84 in the interior of the housing 80. The housing 80 has an inlet opening 86 therein which is positioned so that substantially the entire cross sectional area thereof is below the axis of rotation 83 of the impeller 82. The centrifugal pump assembly 76 is sealingly connected to the discharge portion 68 of the housing 52 so that the inlet opening 86 is substantially aligned with the outlet opening 72 to enable effluent from the interior holding chamber 62 to pass into the pump cavity 84. In this regard, because the inlet opening 86 is offset from the axis of rotation 83, the impeller 82 is operative with a slicing action for macerating waste material entering the pump cavity 84 through the inlet opening 86. Also formed in the pump housing 80 is a drain plug assembly 88 and a discharge line 90 which extends upwardly in substantially tangential relation from the circular impeller cavity 84. As illustrated in FIGS. 1 through 3, the discharge line 90 extends upwardly and then inwardly toward the toilet unit 12 and it preferably has a reduced diameter of approximately one and one half inches to prevent large solid objects from passing upwardly through the centrifugal pump assembly 76. A clean out plug 92 is provided in the discharge line 90 and the discharge pipe assembly 78 is connected to the outlet of the discharge line 90. The centrifugal pump assembly 76 further comprises an electric motor 94 which is controlled by a timer assembly 96 for energizing the discharge pump assembly 16 at preselected time intervals. In this regard, it will be understood that various other control mechanisms can be utilized for controlling the operation of the discharge pump assembly 16, such as manual control mechanisms or control mechanisms which are responsive to the level of effluent in the interior holding chamber 62 or to the number of flushes of the toilet unit 12.

The discharge pipe assembly 78 includes a substantially horizontal main section 98 which is connected to the discharge line 90, an elbow section 100 which is connected to the main section 98 and an outlet section 102 which extends downwardly from the elbow section 100. The main section 98, the elbow section 100 and the outlet section 102 preferably all have diameters of approximately two inches and they are operative for conducting waste material from the discharge line 90 to the sewer line 20. The outlet section 102 includes an outlet flange 104 which is adapted to be connected to a conventional domestic wax-ring flange connection in order to sealingly connect the discharge pipe assembly 78 to the sewer pipe 20. Also included in the outlet section 102 is a drain outlet 106 including a threaded drain plug 108. As will be seen, from FIG. 1, the housing 52 and the discharge pipe assembly 78 are preferably constructed so that the outlet section 102 passes downwardly through the notch 66 in the housing portion 52. Further, in order to make the toilet 10 as compact as possible while nevertheless enabling it to be installed in place of a conventional domestic flush toilet the outlet section 102 is preferably positioned so that the axis thereof is spaced forwardly from the rearmost extremity of the discharge pump assembly 16 by approximately 12 inches so that it can be connected to a conventional sewer line which is normally spaced forwardly from a wall by approximately 12 inches.

For use and operation of the toilet 10 the foot pedal 42 is operated as needed to flush the toilet unit 12 in a conventional manner. Whenever the toilet unit 12 is flushed, waste material passing downwardly through the outlet passage 26 gravitates into the holding chamber 62 where it flows rearwardly along the bottom wall 56. When a quantity of preferably at least approximately two gallons has accumulated in the holding chamber 62 the discharge pump assembly 16 is actuated to operate the centrifugal pump assembly 76 to withdraw waste effluent from the holding chamber 62 and discharge it through the discharge pipe assembly 78. In this regard, as the centrifugal pump assembly 76 is operated to withdraw waste material from the holding chamber 62, the waste material passes into the pump cavity 84 through the inlet opening 86 which is offset from the axis 83 of the impeller 82. As a result, the waste effluent from the holding chamber 62 is macerated as it is passed through the centrifugal pump assembly 76 and it is then discharged through the restricted discharge line 90 so that large solids are prevented from passing outwardly through the discharge pipe assembly 78. In the event that the outlet line 90 becomes clogged, access to the interior of the exhaust pipe assembly can be gained through the clean out plug 92. However, during normal operation, because a relatively large quantity of waste effluent is discharged into the sewer line 20 whenever the discharge pump assembly 16 is actuated, the macerated waste material normally has sufficient velocity to enable it to pass through the sewer line 20 without clogging. Accordingly, although the toilet unit 12 is adapted for flushing with relatively small quantities of water, such as quantities of approximately one pint, the toilet 10 is nevertheless capable of exhausting sufficient quantities of waste effluent into the sewer line 20 at one time to minimize the potential for clogging the sewer line 20.

It is seen therefore that the instant invention provides an effective toilet construction. The toilet unit 12 is operative for flushing with relatively small quantities of water and the holding tank unit 14 is operative for holding waste material discharged from the toilet unit 12 so that a relatively large quantity of waste effluent can be discharged at one time. The discharge pump assembly 16 is operative for macerating waste material from the holding chamber 62 and for discharging the macerated waste material into the sewer line 20 at a rate which normally causes the macerated material to flow through the sewer line 20 without clogging. Accordingly, it is seen that the toilet 10 can be effectively utilized for conserving substantial quantities of water and that it therefore represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A water saving toilet construction comprising:

a. a toilet unit including a bowl portion, an outlet portion defining an outlet passage which opens directly downwardly from said bowl portion, closure means operable in a closed position for closing said outlet passage and an open position wherein waste material from said bowl portion can pass directly downwardly from said bowl portion through said outlet passage, and flushing means connectible to a supply of water and capable of being operated for flushing said bowl portion and said outlet portion with a quantity of less than approximately one gallon of water;

b. holding tank having an upwardly opening waste inlet opening which extends directly downwardly into an interior holding chamber, said toilet unit being received on said holding tank means and being sealingly connected thereto so that waste passing outwardly from said toilet unit through said outlet passage passes through said inlet opening and into said interior holding chamber, said interior holding chamber having an interior volume of at least approximately two and one half gallons, said holding tank means having front and rear ends and including a bottom wall which defines the bottom of said interior chamber, said holding tank means having a discharge opening adjacent the rear end thereof and having a notched area formed therein which extends forwardly from the rear end thereof to a point which is spaced forwardly from said discharge opening, said bottom wall being inclined downwardly and rearwardly from a point directly beneath said holding tank means inlet opening to said discharge opening, said holding tank means being receivable on a substantially horizontal floor surface for supporting said toilet unit at a normal toilet seating height thereon;

c. a discharge pump adjacent the rear end of said holding tank means, said discharge pump having a pump inlet and communicating with said holding tank means discharge opening through said pump inlet, said discharge pump defining the rearmost extremity of said toilet construction; and d. a discharge pipe connected to said discharge pump, said discharge pipe extending upwardly and forwardly from said discharge pump to approximate the elevation of said holding tank means waste inlet opening and then downwardly through said notched area to a downwardly opening discharge outlet, said discharge outlet having a central axis which is spaced forwardly from the rearmost extremity of said toilet construction by approximately 12 inches and being connectible to a sewer pipe opening upwardly through said floor surface.

2. In the toilet construction of claim 1, said outlet portion passing substantially directly downwardly from said bowl portion, said holding tank means waste inlet opening further characterized as opening upwardly and being connected to said outlet portion, said holding tank means waste inlet opening extending substantially directly downwardly into said interior holding chamber.

3. In the toilet construction of claim 2, said closure means further characterized as mechanical closure means selectively operable in a closed position for mechanically obstructing said outlet portion and an open position wherein waste material from said bowl portion is free to gravitate downwardly and outwardly from said bowl portion through said outlet portion.

4. In the toilet construction of claim 1, said holding tank means having an interior bottom wall which defines the bottom of said interior chamber, said bottom wall being inclined downwardly from a point beneath said holding tank means waste inlet opening to said discharge means.

5. In the toilet construction of claim 4, said interior bottom wall being inclined downwardly at an angle of at least approximately 10°.

6. In the toilet construction of claim 5, said holding tank means having front and rear ends, said bottom wall being inclined downwardly from said front end toward said rear end, said holding tank means waste inlet opening being forward of the midpoint between said front and rear ends.

7. In the toilet construction of claim 6, said holding tank means having a volume of less than approximately six gallons.

8. In the toilet construction of claim 1, said holding tank means having a volume of less than approximately six gallons.

9. In the toilet construction of claim 8, said toilet unit being supported on said holding tank means.

10. In the toilet construction of claim 1, said notched area extending forwardly to a point which is at least partially directly beneath said toilet unit.

11. In the toilet construction of claim 1, said holding tank means having opposite sides, said notched area being substantially uniformly spaced from said opposite sides.

12. In the toilet construction of claim 1, said pump inlet being at least partially below the upper surface of the adjacent portion of said bottom wall.

* * * * *